US005453344A

United States Patent [19]

Malhotra et al.

[11] Patent Number: 5,453,344

[45] Date of Patent: Sep. 26, 1995

[54] LAYERED IMAGING MEMBERS WITH BINDER RESINS

[75] Inventors: Shadi L. Malhotra; Dasarao K. Murti, both of Mississauga; Brent S. Bryant, Milton, all of Canada

[73] Assignee: Xerox Corporation, Stamford, Conn.

[21] Appl. No.: 187,988

[22] Filed: Jan. 28, 1994

[51] Int. Cl.[6] ..... G03G 5/047

[52] U.S. Cl. ..... 430/59; 430/58

[58] Field of Search ..... 430/58, 59

[56] References Cited

U.S. PATENT DOCUMENTS

| | | | |
|---|---|---|---|
| 3,121,006 | 6/1957 | Middleton et al. . | |
| 3,859,089 | 1/1975 | Chambers | 430/96 X |
| 3,929,480 | 12/1975 | Perlis et al. | 430/96 X |
| 4,265,990 | 5/1981 | Stolka et al. | 430/59 |
| 4,349,617 | 9/1982 | Kawashiri et al. | 430/59 |
| 4,464,450 | 8/1984 | Teuscher | 430/59 |
| 4,699,865 | 10/1987 | Mitsuhashi | 430/101 |
| 4,713,307 | 12/1987 | Law et al. | 430/57 |

*Primary Examiner*—Roland Martin
*Attorney, Agent, or Firm*—E. O. Palazzo

[57] ABSTRACT

An imaging member comprised of supporting substrate, a photogenerator layer and a charge transport layer comprised of charge transport molecules dispersed in a resin binder comprised of styrene-arylmethacrylate polymers, styrene-alkylmethacrylate polymers, styrene-diene polymers, alpha-methylstyrene polymers, or vinyl polymers.

22 Claims, 4 Drawing Sheets

LAYERED IMAGING MEMBERS WITH BINDER RESINS

BACKGROUND OF THE INVENTION

Figure 1:
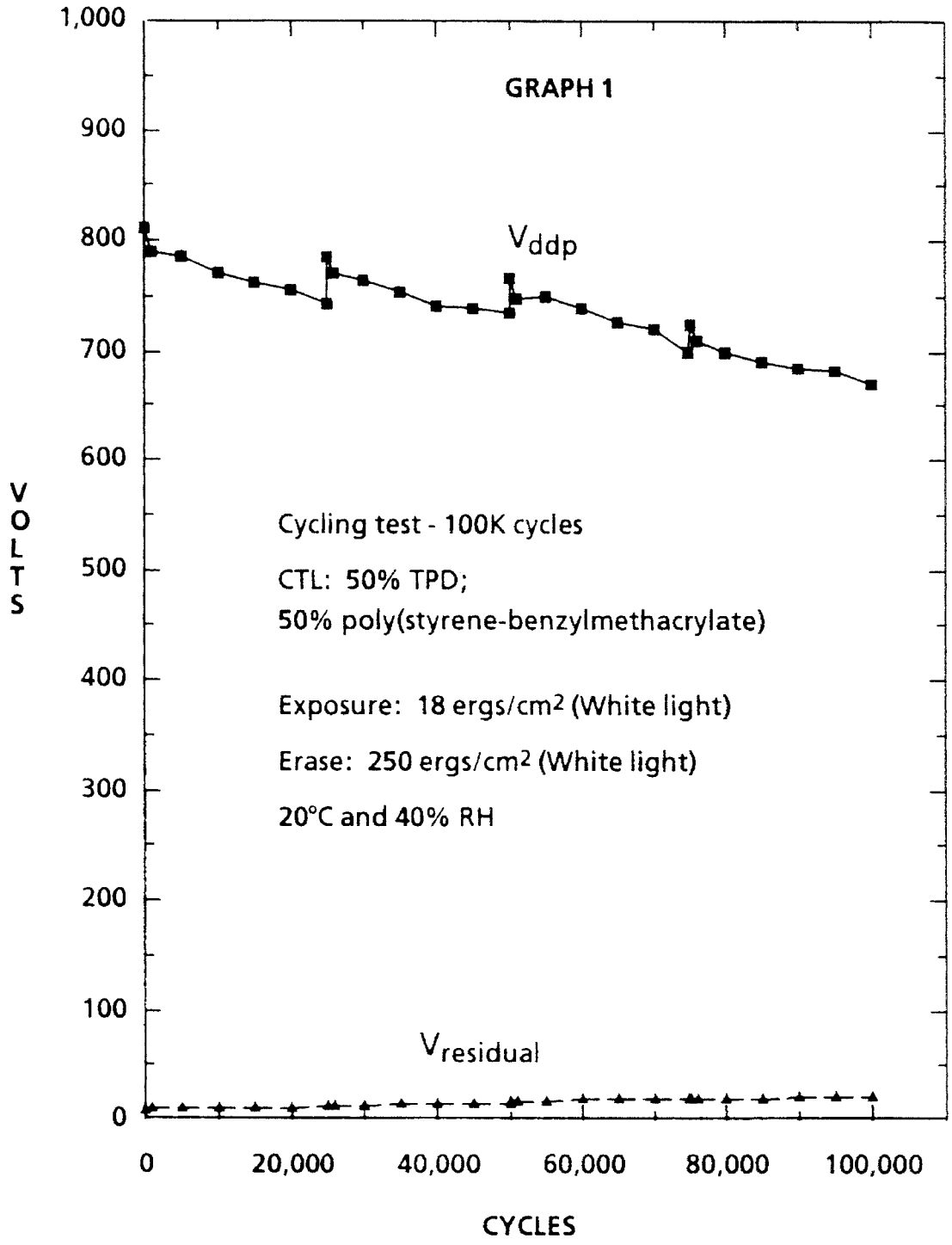

The present invention is directed generally to photoresponsive, or photoconductive imaging members, and more specifically to photoconductive imaging members comprised of certain resin binders. In embodiments, the present invention is directed to an imaging member comprised of a supporting substrate, a photogenerating layer in contact therewith, and a charge, especially hole, transport layer comprised of transport molecules dispersed in improved binders of, for example, copolymers and diblock copolymers of styrene and alkyl methacrylates, styrene aryl methacrylates, styrene diene copolymers or substituted alphamethylstyrene and substituted styrene, and vinyl polymers. The resin binders in embodiments are comprised of block copolymers of styrene with alkyl methacrylates such as benzylmethacrylates and cyclohexylmethacrylates, styrene arylmethacrylates such as styrene phenyl methacrylate, styrene diene copolymers such as styrene isoprene copolymers or substituted poly(alpha-methylstyrene) such as poly(p-isopropyl alpha-methyl styrene), and substituted polystyrenes such as poly(alpha-methylstyrene) and vinyl polymers such as poly(vinyl toluene) poly(p-isopropyl alpha-methyl styrene) and poly(vinyl benzyl chloride) and the like. With the binders of the present invention, toxic solvents, such as chlorinated solvents like dichloromethane; can be avoided when preparing the resulting imaging members. Moreover, the imaging members with the binders of the present invention are electrically and environmentally stable, possess excellent mechanical and xerographic cycling properties, for example increases in background and residual potentials of only 10 volts in 1,000 imaging cycles enabling their use for extended imaging cycles of, for example, 500,000. Also, the imaging members of the present invention can be rendered sensitive to wavelengths of from about 400, especially 450 to about 800 nanometers, that is from the visible region to the near infrared wavelength region of the light spectrum, and these imaging members in many instances possess excellent electricals, and outstanding time zero electricals, such as a dark decay of −30 volts/second, and $E_{1/2}$ of about 1.5 ergs/cm$^2$ at 790 nanometers, thus enabling use thereof in imaging systems with high speeds, for example exceeding 70 CPM, and have excellent cycling characteristics. In embodiments thereof, the imaging members of the present invention generally possess lower dark decay characteristics as illustrated herein.

Photoresponsive and photoconductive imaging members are known, such as those comprised of a homogeneous layer of a single material such as vitreous selenium, or composite layered devices containing a dispersion of a photoconductive composition. An example of a composite xerographic photoconductive member is described in U.S. Pat. No. 3,121,006, which discloses finely divided particles of a photoconductive inorganic compound dispersed in an electrically insulating organic resin binder.

Photoreceptor materials comprising inorganic or organic materials wherein the charge generating and charge transport functions are performed by discrete contiguous layers are also known. Additionally, layered photoreceptor members are disclosed in the prior art, including photoreceptors having an overcoat layer of an electrically insulating polymeric material. Other layered photoresponsive devices have been disclosed, including those comprising separate photogenerating layers and charge transport layers as described in U.S. Pat. No. 4,265,990, the disclosure of which is totally incorporated herein by reference. Photoresponsive materials containing a hole injecting layer overcoated with a hole transport layer, followed by an overcoating of a photogenerating layer, and a top coating of an insulating organic resin are disclosed in U.S. Pat. No. 4,251,612, the disclosure of which is totally incorporated herein by reference. Examples of photogenerating layers disclosed in these patents include trigonal selenium and phthalocyanines, while examples of transport layers include certain aryl diamines as illustrated therein. Examples of binders include polycarbonates and polyesters.

Examples of the highly insulating and transparent resinous components or inactive binder resinous material for the transport layer include materials such as those described in U.S. Pat. No. 3,121,006, the disclosure of which is totally incorporated herein by reference. Specific examples of suitable organic resinous materials include polycarbonates, acrylate polymers, vinyl polymers, cellulose polymers, polyesters, polysiloxanes, polyamides, polyurethanes, polystyrenes, and epoxies as well as block, random or alternating copolymers thereof. Preferred electrically inactive binder materials are polycarbonate resins having a molecular weight of from about 20,000 to about 100,000 with a molecular weight in the range of from about 50,000 to about 100,000 being particularly preferred. Generally, the resinous binder contains from about 5 to about 90 percent by weight of the active material corresponding to the foregoing formula, and preferably from about 20 percent to about 75 percent of this material. In methods known for the preparation of imaging members containing polycarbonate resins as inactive binder materials by web coating and dip coating processes, solvents like dichloromethane and chlorobenzene are used. Similar binder materials may be selected for the photogenerating layer, including polyesters, polyvinyl butyrals, polyvinylcarbazole, polycarbonates, polyvinyl formals, poly(vinylacetals) and the like, reference U.S. Pat. No. 3,121,006, the disclosure of which is totally incorporated herein by reference. There is an increasing concern about the use of chlorinated solvents like dichloromethane in these processes and there are indications that future governmental regulations will require the elimination and or reduction of chlorinated solvent emissions. There is a need to identify less harmful polymer/solvent systems that are compatible with the charge transporting materials so that alternate photoreceptor manufacturing processes can be developed. In addition, there is a need to improve the mechanical properties of the photoreceptors.

U.S. Pat. No. 4,713,307, the disclosure of which is hereby totally incorporated by reference, also discloses photoconductive imaging members containing a supporting substrate, certain azo pigments as photogenerating materials, and a hole transport layer that preferably contains an aryl diamine compound dispersed in certain inactive resinous binder.

Documents illustrating layered organic electrophotographic photoconductor elements with azo, bisazo, and related compounds with hole transports and certain binders that are believed to require the use of toxic solvents like methylene chloride for their preparation include U.S. Pat. Nos. 4,390,611, 4,551,404, 4,596,754, 4,400,455, 4,390,608, 4,327,168, 4,299,896, 4,314,015, 4,486,522, 4,486,519, 4,555,667, 4,440,845, 4,486,800, 4,309,611, 4,418,133, 4,293,628, 4,427,753, 4,495,264, 4,359,513, 3,898,084, 4,830,944 and 4,820,602.

FIGURES

Illustrated in FIGS. 1, 2, 3 and 4 are graphs providing the results of xerographic cycling, wherein the volts are plotted against the number of cycles, reference Example X.

SUMMARY OF THE INVENTION

It is an object of the present invention to provide imaging members with many of the advantages illustrated herein.

It is another object of the present invention to provide imaging members with resin binders, especially for the hole transport molecules, which resin binders can be formulated without toxic chlorinated solvents.

It is another object of the present invention to provide photoconductive imaging members with enhanced photosensitivity from the visible to the infrared wavelength regions of the light spectrum, such as from about 400 to about 800 nanometers.

One embodiment of the present invention is directed to layered imaging members comprised of supporting substrate, a photogenerating layer comprised of photogenerating pigments and thereover a charge transport layer comprised of aryldiamines dispersed in certain resin binders.

In embodiments, the imaging members of the present invention are comprised of, in the order indicated, a conductive substrate, a photogenerating layer optionally dispersed in a resinous binder composition, and a charge transport layer, which comprises charge transporting molecules dispersed in a certain inactive resinous binder composition.

In another embodiment, the photoconductive imaging member comprises a conductive substrate, a hole transport layer comprising a hole transport composition, such as an aryl amine, dispersed in a certain inactive resinous binder composition, and as a top layer a photogenerating layer comprising photogenerating pigments optionally dispersed in a resinous binder composition; or a conductive substrate, a hole blocking metal oxide layer, an optional adhesive layer, a photogenerating layer optionally dispersed in a resinous binder composition, and an aryl amine hole transport layer comprising aryl amine hole transport molecules dispersed in certain resinous binders.

Examples of resin binders selected for the imaging members of the present invention include a block copolymer of polystyrene (PS)-poly(benzyl methacrylate) (PBMA) preferably with 56 percent of PS and 44 percent of PBMA, and with a $M_w$=3.59×10$^5$, $M_n$=5.2×10$^4$; a block copolymer of polystyrene (PS)-poly(cyclohexyl methacrylate) (PCHMA) preferably with PS, 60 percent, and PCHMA, 40 percent, and with $M_w$=4.0×10$^5$, $M_n$=1.0×10$^5$; a block copolymer of polystyrene (PS)-poly(phenyl methacrylate) (PPhMA) preferably with 60 percent of PS and 40 percent of PPhMA, and with $M_w$=3.75×10$^5$, $M_n$=1.0×10$^5$. Generally, there can be selected as the resin binder poly(alpha-methylstyrene), poly(p-isopropylalpha-methyl styrene), poly(vinyl toluene), and poly(vinylbenzyl chloride) with weight average molecular weights of greater than about 2.5×10$^4$; black copolymers of isoprene and methacrylates; and the like. The block copolymers illustrated herein can be prepared by ultrasonic polymerizations, and more specifically as follows. Ultrasonic polymerizations were accomplished in a batch reactor, for example 10 centimeters long, 5 centimeters diameter, and 200 milliliters capacity, equipped with water jackets to maintain a 2° C. temperature measured with a Ni—Cr alloy probe and a Comark digital thermometer. Prior to subjecting the polymer solutions to ultrasonic treatments, they were purged with nitrogen for a period of 30 minutes. The sealed aluminum reactor was screwed onto a threaded nodal point on a 1.25 centimeters diameter disrupter horn (Heat Systems Model 375A with a nominal frequency of 20 kHz) where attachment produces no damping. Ultrasonic intensity of 70 watts was adjusted using the calibration curve of meter reading, power control setting, and power output in watts provided by the manufacturer. After sonicating the polymer solution for the desired period of time, it was transferred to a 1 liter beaker and the solvent was removed by evaporation. The dried products were subjected to fractionation for the removal of homopolymers by using different solvent/nonsolvent systems. Solvent pairs were chosen wherein each solvent dissolved only one of the polymers and acted as a nonsolvent for the other. Organic solvents, such as toluene, acetone and the like, in various effective amounts of, for example, from about 100 to about 400 and preferably 200 milliliters and nonsolvents such as heptane, methanol, isopropanol and 50 percent of heptane, 50 percent of acetone in amounts of, for example, from about 300 to about 600 and preferably 500 milliliters, can be selected. The products recovered after fractionation were analyzed by infrared (IR), gel permeation chromatography (GPC) and viscometry (η). These binders contain styrene units which are compatible at a molecular level with aryl amine hole transport molecules and thus perform better than or equivalent to those not containing styrene units with respect to, for example, inhibition of crystallization of aryl amine hole transport molecules and longer life of the imaging member.

Poly(p-isopropyl alpha-methyl styrene) with $M_w$=8.0×10$^4$; poly alpha-methyl styrene of molecular weight $M_w$=1.0×105; styrene-isoprene block copolymer with styrene content of 47 percent by weight and $M_w$=7.7×10$^4$ and $M_w/M_n$ ratio of 1.5 were synthesized via anionic living polymerization. Details of the synthetic procedures and molecular weights are illustrated herein. Poly(vinyl benzyl chloride) with $M_w$=5×10$^5$ and poly(vinyl toluene) with $M_w$=8.0×10$^4$ were obtained from Scientific Polymer Products.

The substrate can be formulated entirely of an electrically conductive material, or it can be an insulating material having an electrically conductive surface. The substrate is of an effective thickness, generally up to about 100 mils, and preferably from about 1 to about 50 mils, although the thickness can be outside of this range. The thickness of the substrate layer depends on many factors, including economic and mechanical considerations. Thus, this layer may be of substantial thickness, for example over 100 mils, or of minimal thickness provided that there are no adverse effects on the system. In a particularly preferred embodiment, the thickness of this layer is from about 3 mils to about 10 mils. The substrate can be opaque or substantially transparent and can comprise numerous suitable materials having the desired mechanical properties. The entire substrate can comprise the same material as that in the electrically conductive surface, or the electrically conductive surface can merely be a coating on the substrate. Any suitable electrically conductive material can be employed. Typical electrically conductive materials include copper, brass, nickel, zinc, chromium, stainless steel, conductive plastics and rubbers, aluminum, semitransparent aluminum, steel, cadmium, titanium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. The substrate layer can vary in thickness over substantially wide ranges depending on the desired use of the electrophotoconductive member. Generally, the conductive layer ranges in thickness of from about 50 Angstroms to many centimeters, although the thickness can be outside of this range. When a flexible electrophotographic imaging member is desired, the thickness typically is from about 100 Angstroms to about 750 Angstroms. The substrate can be of any other conventional material, including organic and inorganic materials. Typical substrate materials include insulating nonconducting materials such as various resins known for this purpose including polycarbonates, polyamides, polyurethanes, paper, glass, plastic, polyesters such as MYLAR® (available from DuPont) or MELINEX 447® (available from ICI Americas, Inc.), and the like. If desired, a conductive substrate can be coated onto an insulating material. In addition, the substrate can comprise a metallized plastic, such as titanized or aluminized MYLAR®, wherein the metallized surface is in contact with the photogenerating layer or any other layer situated between the substrate and the photogenerating layer. The coated or uncoated substrate can be flexible or rigid, and can have any number of configurations, such as a plate, a cylindrical drum, a scroll, an endless flexible belt, or the like. The outer surface of the substrate preferably comprises a metal oxide such as aluminum oxide, nickel oxide, titanium oxide, and the like.

In embodiments, intermediate adhesive layers between the substrate and subsequently applied layers may be desirable to improve adhesion. If such adhesive layers are utilized, they preferably have a dry thickness of from about 0.1 micron to about 5 microns, although the thickness can be outside of this range. Typical adhesive layers include film-forming polymers such as polyester, polyvinylbutyral, polyvinylpyrolidone, polycarbonate, polyurethane, polymethylmethacrylate, and the like as well as mixtures thereof. Since the surface of the substrate can be a metal oxide layer or an adhesive layer, the expression "substrate" as employed herein is intended to include a metal oxide layer with or without an adhesive layer on a metal oxide layer.

Photogenerating pigments are known and include metal phthalocyanines, metal free phthalocyanines, vanadyl phthalocyanines, titanyl phthalocyanines, reference for example U.S. Pat. Nos. 5,206,359 (D/91151), 5,189,156 (D/91152), and 5,189,155 (D/91153), the disclosures of which are totally incorporated herein by reference; selenium, trigonal selenium, selenium alloys, such as selenium arsenic, selenium-arsenic, tellurium, selenium-tellurium, and the like. Also, photogenerating pigments are illustrated in U.S. Pat. No. 4,265,990, the disclosure of which is totally incorporated herein by reference.

The photogenerating layer is of an effective thickness, for example, of from about 0.05 micron to about 10 microns or more, and in embodiments has a thickness of from about 0.1 micron to about 3 microns. The thickness of this layer, however, is dependent primarily upon the concentration of photogenerating material in the layer, which may generally vary from about 5 to 100 percent. When the photogenerating material is present in a binder material, the binder preferably contains from about 30 to about 95 percent by weight of the photogenerating material, and preferably contains about 80 percent by weight of the photogenerating material. Generally, it is desirable to provide this layer in a thickness sufficient to absorb about 90 percent or more of the incident radiation which is directed upon it in the imagewise or printing exposure step. The maximum thickness of this layer is dependent primarily upon factors such as mechanical considerations, such as the specific photogenerating compound selected, the thicknesses of the other layers, and whether a flexible photoconductive imaging member is desired.

Charge transport layers are well known in the art. Typical transport layers are described, for example, in U.S. Pat. Nos. 4,265,990; 4,609,605; 4,297,424 and 4,921,773, the disclosures of each of these patents being totally incorporated herein by reference. Organic charge transport materials can also be employed. Typical charge, especially hole, transporting materials include the following.

Hole transport molecules of the type described in U.S. Pat. Nos. 4,306,008; 4,304,829; 4,233,384; 4,115,116; 4,299,897; 4,081,274, and 5,139,910, the disclosures of each of which are totally incorporated herein by reference, can be selected for the imaging members of the present invention. Typical diamine hole transport molecules include N,N'-diphenyl-N,N'-bis( 3-methylphenyl)-(1,1'-biphenyl)-4,4'-diamine, N,N'-diphenyl-N,N'-bis(4-methylphenyl)-(1,1'-biphenyl)-4,4'-diamine, N,N'-diphenyl-N,N'-bis(2-methylphenyl)-( 1,1'-biphenyl)-4,4'-diamine, N,N'-diphenyl-N,N'-bis(3-ethylphenyl)-( 1,1'-biphenyl)-4,4'-diamine, N,N'-diphenyl-N,N'-bis(4-ethylphenyl)-(1,1'-biphenyl)-4,4'-diamine, N,N'-diphenyl-N,N'-bis(4-n-butylphenyl)-( 1,1'-biphenyl)-4,4'-diamine, N,N'-diphenyl-N,N'-bis(3-chlorophenyl)-( 1,1'-biphenyl)-4,4'-diamine, N,N'-diphenyl-N,N'-bis(4-chlorophenyl)-(1,1'-biphenyl)-4,4'-diamine, N,N'-diphenyl-N,N'-bis(phenylmethyl)-( 1,1'-biphenyl)-4,4'-diamine, N,N,N',N'-tetraphenyl-[2,2'-dimethyl-1,1'-biphenyl]-4,4'-diamine, N,N,N',N'-tetra-(4-methylphenyl)-[2,2'-dimethyl-1,1'-biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis(2-methylphenyl)-[2,2 '-dimethyl-1,1'-biphenyl]-4,4'-diamine, N,N'-diphenyl-N,N'-bis( 3-methylphenyl)-[2,2'-dimethyl-1,1'-biphenyl]-4,4'-diamine, N,N'-diphenyl-N,N'-bis(3-methylphenyl)-pyrenyl-1,6-diamine, and the like.

Pyrazoline transport molecules as disclosed in U.S. Pat. Nos. 4,315,982; 4,278,746 and 3,837,851, the disclosures of each of which are totally incorporated herein by reference, can also be selected. Typical pyrazoline transport molecules include 1-[lepidyl-(2)]-3-(p-diethylaminophenyl)- 5-(p-diethylaminophenyl)pyrazoline, 1-[quinolyl-(2)]-3-(p-diethylaminophenyl)-5-(p-diethylaminophenyl)pyrazoline, 1-[pyridyl-(2)]-3-(p-diethylaminostyryl)-5-(p-diethylaminophenyl)pyrazoline, 1-[6-methoxypyridyl-( 2)]-3-(p-diethylaminostyryl)-5-(p-diethylaminophenyl)pyrazoline, 1-phenyl-3-[p-dimethylaminostyryl]-5-(p-dimethylaminostyryl)pyrazoline, 1-phenyl-3-[p-diethylaminostyryl]-5-(p-diethylaminostyryl)pyrazoline, and the like.

Substituted fluorene charge transport molecules as described in U.S. Pat. No. 4,245,021, the disclosure of which is totally incorporated herein by reference, can also be selected. Typical fluorene charge transport molecules include 9-(4'-dimethylaminobenzylidene)fluorene, 9-(4'-methoxybenzylidene)fluorene, 9-(2',4'-dimethoxybenzylidene)fluorene, 2-nitro-9-benzylidenefluorene, 2-nitro-9-(4'-diethylaminobenzylidene)fluorene, and the like.

Oxadiazole transport molecules such as 2,5-bis(4-diethylaminophenyl)- 1,3,4-oxadiazole, pyrazoline, imidazole, triazole, and the like can be selected for the charge transport later. Other typical oxadiazole transport molecules are described, for example, in German Patents 1,058,836; 1,060, 260 and 1,120,875, the disclosures of each of which are totally incorporated herein by reference, can also be selected.

In embodiments of the present invention, a preferred hole transport layer is comprised of components as represented, or essentially represented, by the following general formula

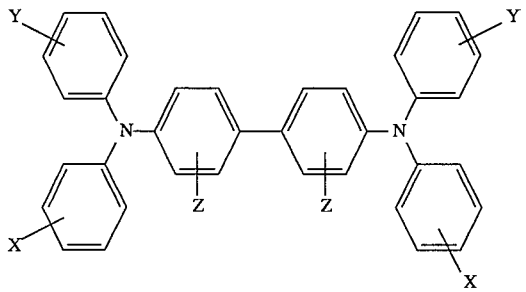

wherein X, Y and Z are selected from the group consisting of hydrogen, an alkyl group with, for example, from 1 to about 25 carbon atoms and a halogen, preferably chlorine, and at least one of X, Y and Z is independently an alkyl group or chlorine. When Y and Z are hydrogen, the compound may be named N,N'-diphenyl-N,N'-bis(alkylphenyl)-(1,1'-biphenyl)- 4,4'-diamine wherein the alkyl is, for example, methyl, ethyl, propyl, n-butyl, or the like, or the compound may be N,N'-diphenyl-N,N'-bis (chlorophenyl)-( 1,1'-biphenyl)-4,4'-diamine.

The charge transport material is present in the charge transport layer in an effective amount, generally from about 5 to about 90 percent by weight, preferably from about 20 to about 75 percent by weight, and more preferably from about 30 to about 60 percent by weight, although the amount can be outside of this range.

The photoconductive imaging member may optionally contain a charge blocking layer situated between the conductive substrate and the photogenerating layer. This layer may comprise metal oxides, such as aluminum oxide and the like, or materials such as silanes and nylons. Additional examples of suitable materials include polyisobutyl methacrylate, copolymers of styrene and acrylates such as styrene/n-butyl methacrylate, copolymers of styrene and vinyl toluene, polycarbonates, alkyl substituted polystyrenes, styrene-olefin copolymers, polyesters, polyurethanes, polyterpenes, silicone elastomers, mixtures thereof, copolymers thereof, and the like. The primary purpose of this layer is to prevent charge injection from the substrate during and after charging. This layer is of a thickness of less than 50 Angstroms to about 10 microns, preferably being no more than about 2 microns.

In addition, the photoconductive imaging member may also optionally contain an adhesive interface layer situated between the hole blocking layer and the photogenerating layer. This layer may comprise a polymeric material such as polyester, polyvinyl butyral, polyvinyl pyrrolidone and the like. Typically, this layer is of a thickness of less than about 0.6 micron.

The present invention also encompasses a method of generating images with the photoconductive imaging members disclosed herein. The method comprises the steps of generating an electrostatic latent image on a photoconductive imaging member of the present invention, developing the latent image, and transferring the developed electrostatic image to a substrate. Optionally, the transferred image can be permanently affixed to the substrate. Development of the image may be achieved by a number of methods, such as cascade, touchdown, powder cloud, magnetic brush, and the like with known toners comprised of resin, pigment, and charge additive, reference, for example, U.S. Pat. Nos. 4,904,762; 4,560,635 and 4,298,672, the disclosures of which are totally incorporated herein by reference. Transfer of the developed image to a substrate may be by any method, including those making use of a corotron or a biased roll. The fixing step may be performed by means of any suitable method, such as flash fusing, heat fusing, pressure fusing, vapor fusing, and the like. Any material used in xerographic copiers and printers may be used as a substrate, such as paper, transparency material, or the like.

Specific embodiments of the invention will now be described in detail. These Examples are intended to be illustrative, and the invention is not limited to the materials, conditions, or process parameters set forth in these embodiments. All parts and percentages are by weight unless otherwise indicated.

In the following Examples, the procedure for synthesizing block copolymers using ultrasound has been described in *J. Macromol. Sci. Chem.*, A18(5) 783(1982), the disclosure of which is totally incorporated herein by reference.

When an ultrasound field is applied to a polymer solution, cavitation results and a small fraction of energy is used in shearing the molecules to yield homolytic cleavage. When this is accomplished in the presence of two homopolymers, the reactions lead to the formation of block copolymers which would contain segments from both homopolymers. When preparing block copolymers in embodiments with ultrasonic polymerization, it is important that the two polymers be soluble in a common solvent.

Ultrasonic polymerizations were accomplished in a batch reactor, 10 centimeters long, 5 centimeters diameter, 200 milliliters capacity, equipped with water jackets to maintain a 2° C. temperature differentiation measured with a Ni—Cr alloy probe and a Comark digital thermometer. Prior to subjecting the polymer solutions to ultrasonic treatments, they were purged with nitrogen for a period of 30 minutes (min). The sealed aluminum reactor was screwed onto a threaded nodal point on a 1.25 centimeters diameter disrupter horn (Heat Systems Model 375A with a nominal frequency of 20 kHz) where attachment produces no damping. Ultrasonic intensity of 70 watts was adjusted using the calibration curve of meter reading, power control setting, and power output in watts provided by the manufacturer. After sonicating the polymer solution for the desired period of time, it was transferred to a 1 liter beaker and the solvent was removed by evaporation. The dried products were subjected to fractionation for the removal of homopolymers by using different solvent/nonsolvent systems. Solvent pairs were chosen in such a way that each solvent dissolved only one of the polymers and acted as a nonsolvent for the other. All products recovered after fractionation were analyzed by infrared (IR), gel permeation chromatography (GPC) and viscometry ($\eta$).

EXAMPLE I

The synthesis of polystyrene (PS)-poly(benzyl methacrylate) (PBMA) is described in this Example. 2.0 Grams of polystyrene with a weight average molecular weight ($M_w$) equal to $1.8\times10^6$, a number average molecular weight ($M_n$) equal to $1.24\times10^6$, a $M_w/M_n$ of =1.45, [$\eta$]=4.8 dL/gram in toluene, and 2.0 grams of poly(benzyl methacrylate) ($M_w$= $1.9\times10^5$, $M_w/M_n$=6.35, [$\eta$]=0.22 dL/gram) obtained from Aldrich Chemical Company were dissolved in 175 milliliters (millimeters) of toluene, purged with nitrogen for 30 minutes, and sonicated for 180 minutes at 27° C. Evaporation of the solvent toluene yielded a mixture of dry polymers from which 100 milligrams of polystyrene ($M_w$=1.3×10$^5$, $M_n$=7.06×10$^3$) was recovered with cyclohexane and subsequent washings with a mixture of methyl ethyl ketone (200 millimeters) and isopropanol (800 millimeters) followed by washing with acetone yielded 500 milligrams of poly(benzyl methacrylate) (PBMA), ($M_w$=3.05×10$^5$, $M_n$=3.0×10$^4$, [η]=0.26 dL/grams) contaminated with polystyrene (PS), leaving behind 3.4 grams of the block copolymer, 56 percent of polystyrene (PS)-44 percent of poly(benzyl methacrylate) (PBMA) with a $M_w$=3.59×10$^5$, $M_n$=5.2×10$^4$, [η]=0.94, dL/gram.

EXAMPLE II

The synthesis of polystyrene (PS)-poly(cyclohexyl methacrylate) (PCHMA) is described in this Example. 2.0 Grams of polystyrene ($M_w$=1.8×10$^6$, $M_w/M_n$=1.45, [η]=4.8 dL/g) and 2.0 grams of poly(cyclohexyl methacrylate) ($M_w$=2.54×10$^5$, $M_w/M_n$=6.6, [η]=0.365 dL/gram) were dissolved in 175 millimeters of toluene, purged with nitrogen for 30 minutes, and sonicated at 27° C. for 180 minutes. Evaporation of the toluene solent yielded a mixture of dry polymers from which 700 milligrams of poly(cyclohexyl methacrylate) ($M_w$=2.5×10$^5$, $M_w/M_n$=7.0) were recovered with acetone while subsequent washings with cyclohexane yielded only traces of polystyrene leaving behind 3.3 grams of 60 percent polystyrene-40 percent of poly(cyclohexyl methacrylate) with $M_w$=4.0×10$^5$, $M_n$=1.0×10$^5$, [η]=0.80 dL/g).

EXAMPLE III

The synthesis of polystyrene (PS)-poly(phenyl methacrylate) (PphMA) is described in this Example. 2.0 Grams of polystyrene ($M_w$=9.0×10$^5$, $M_w/M_n$=1.1, [η]=2.25 dL/gram) and 2.0 grams of poly(phenyl methacrylate) ($M_w$=2.35×10$^5$, $M_w/M_n$=4.5, [η]=0.25 dL/gram) were dissolved in 175 millimeters of toluene, purged with nitrogen for 30 minutes, and sonicated at 27° C. for 180 minutes. Evaporation of solvent yielded a mixture of dry polymers from which 100 milligrams of polystyrene ($M_w$=2.1×10$^5$, $M_n$=1.1×10$^5$) was recovered with cyclohexane while subsequent washing with mixtures of (heptane+acetone) and (acetone+acetonitrile) yielded 800 milligrams of poly(phenyl methacrylate) ($M_w$=1.72×10$^5$, $M_n$=5.0×10$^4$, [η]=0.21 dL/gram, kH=0.0), leaving behind 3.1 grams of block copolymer, 60 percent, of polystyrene-40 percent of poly(phenyl methacrylate) with $M_w$=3.75×10$^5$, $M_n$=1.0×10$^5$, [η]=0.74 dL/gram.

EXAMPLE IV

In the following Examples, the procedure for synthesizing polymers using living anionic polymerizations was selected and which processes are generally illustrated in the *J. Macromol. Sci. Chem.*, A11(11) 2087 (1977) authored by J. Leonard and S. L. Malhotra, the disclosure of which is totally incorporated herein by reference.

Bulk anionic polymerization of poly(p-isopropyl alpha-methyl styrene) with butyl lithium-tetramethyl ethylene diamine, BuLi-TMEDA complex as an initiator, was effected in screw-capped bottles inside a dry box. These bottles were washed with a sodium dichromate-sulfuric acid mixture, distilled water, methanol, dried in an oven and finally cooled in an atmosphere of nitrogen. Monomer of tetramethyl-1,2-ethylene diamine (TMEDA) and butyl lithium was injected into the bottles in that order until the red color of the solution persisted. The bottles were capped and immersed in a bath set at −78° C. for a period of 30 minutes. After the polymerizations were over, the polymers were precipitated out of methanol. The filtrate was evaporated to recover the methanol-soluble fraction of the polymer, poly(p-isopropyl alpha-methyl styrene), and the residue thus obtained was added to the precipitated polymer.

The molecular weights of the polymer, which could be varied by changing the initiator concentration, were determined using light scattering, osmometry and gel permeation chromatography. The weight average molecular weight $M_w$ of the polymers were measured to be between 3.0×10$^4$ to 8.0×10$^4$ with a $M_w/M_n$ ratio of 1.2. Poly(p-isopropyl alpha-methyl styrene) of $M_w$=8.0×10$^4$ was used in the preparation of photoconductive imaging devices.

EXAMPLE V

Poly alpha-methylstyrene samples were also prepared in a manner similar to those mentioned above for poly(p-isopropyl alpha-methyl styrene). Their molecular weights, $M_w$, were greater than 2.5×10$^4$ and were between 3.0×10$^4$ to 100×10$^4$ with a $M_w/M_n$ ratio of about 1:1. Poly alpha-methyl styrene of molecular weight 1.0×10$^5$ was used to prepare the devices of Example XII.

EXAMPLE VI

Styrene-isoprene block copolymers were synthesized via anionic living polymerization by employing the sequential monomer addition technique with n-butyl lithium as the initiator and tetrahydrofuran as the solvent, reference S. L. Malhotra et al. *J. Macromol Sci. Chem.*, A20(7), 733 (1983), the disclosure of which is totally incorporated herein by reference. Block copolymers of varying composition with a styrene content of about 20 percent to 80 percent, isoprene content of about 80 percent to 20 percent, and molecular weight in the range of 1.0×10$^4$ to 1×10$^6$ were prepared by changing the monomer ratios and the initiator concentration. Styrene-isoprene block copolymer with a styrene content of 47 percent by weight, $M_w$=7.7×10$^4$ and $M_w/M_n$ ratio of 1.5, was used to prepare photoconductive imaging devices as illustrated herein. Poly(vinyl benzyl chloride) with $M_w$=5×10$^5$, and poly(vinyl toluene) with $M_w$=8.0×10$^4$ were obtained from Scientific Polymer Product.

EXAMPLE VII

There was prepared a layered photoconductive imaging member containing a photogenerating trigonal selenium pigment, and an aryl amine hole transport layer as follows.

The photogenerating pigment dispersion was prepared by first dissolving in a 1 ounce brown bottle 52.8 milligrams of polyvinyl formal (obtained from Scientific Polymer Products, Inc., formal content 82 percent, acetate content 12 percent, hydroxy content 6 percent) and 10 milliliters of tetrahydrofuran. To the bottle was then added 211.2 milligrams of trigonal selenium pigment, and about 90 grams of steel shot (⅛ inch diameter, number 302 stainless steel shot). The bottle was then placed on a Red Devil Paint Conditioner (Model 5100X) and shaken for about 30 minutes. The resulting dispersion was coated onto a 7.5 inch by 10 inch brush-grained aluminum substrate obtained from Ron Ink Company using a Gardner Mechanical Drive with a 6 inch wide Bird Film Applicator (0.5 mil wet gap) inside a humidity controlled glove box. The relative humidity of the glove box was controlled by dry air to about 25 percent, or less. The resulting photogenerator layer was air dried for about 30 minutes and then vacuum dried for about 1 hour at 100° C. before further coating. The thickness of the resulting charge generator layer was about 1.0 micron as estimated from TEM micrographs.

The above charge generator layer was overcoated with a hole transport layer comprised of 60 weight percent of the resin binder poly(styrene)-poly(benzyl methacrylate) of Example I and 40 percent of aryl diamine hole transport molecules prepared as follows. A solution containing 4.2 grams of the aforementioned resin binder, 2.8 grams of N,N'-bis(3"-methylphenyl)-1,1'-biphenyl-4,4'-diamine prepared as illustrated in U.S. Pat. No. 4,265,990, the disclosure of which is totally incorporated herein by reference, was prepared by dissolving the above materials in 31 milliliters of toluene inside a 2 ounce amber bottle. The transport layer was obtained by coating the solution onto the charge generator layer using a 3.5 inch wide, 5 mil wet gap Bird Film Applicator resulting in a transport layer about 27 microns thick. The resulting photoconductive device was air dried for about 1 hour and vacuum dried at 100° C. for about 16 hours before evaluation on a flat plate imaging test fixture.

More specifically, the imaging member thus prepared was evaluated as follows. Xerographic measurements were made on a flat plate scanner using 2 inch by 2.5 inch samples of the imaging member prepared as described herein. The surface potential of the device was monitored with a capacitively coupled ring probe connected to a Keithley electrometer (Model 610C) in the coulomb mode. The surface potentials attained an initial value of $V_0$. After resting for 0.5 second in the dark, the imaging members acquired a surface potential of $V_{ddp}$, the dark development potential, and was then exposed to light from a filtered Xenon lamp with a XBO 150 watt bulb. A reduction in surface potential was observed. The background potential was reduced by exposing with a light intensity about 10 times greater than the expose energy. The resulting potential on the imaging member was designated as the residual potential, $V_r$. The dark decay in volt/second was calculated as $(V_0-V_{ddp})/0.5$. The percent of photodischarge was calculated as 100 percent $(V_{ddp}-V_{bg})/V_{ddp}$. The photosensitivity of the imaging member is usually provided in terms of the amount of expose energy in ergs/cm$^2$, designated as $E_{1/2}$, required to achieve 50 percent of photodischarge from the dark development potential. The imaging member of this Example exhibited a dark development potential ($V_{ddp}$) of −900 volts, a dark decay of −37 volts per second, and a photosensitivity as measured by an $E_{1/2}$ of 1.6 ergs/cm$^2$.

EXAMPLE VIII

There was prepared a photoconductive imaging member by the fabrication procedures of Example VIII with the exception that a titanized MYLAR® substrate was used in place of the aluminum substrate and the resin binder was the poly(p-isopropyl alpha-methyl styrene) of Example IV. This imaging member exhibited a dark development potential ($V_{ddp}$) of −840 volts, a dark decay of −30 volts per second, and a photosensitivity as measured by $E_{1/2}$ of 1.8 ergs/cm$_2$.

EXAMPLE IX

There was prepared a photoconductive imaging member by the fabrication procedure of Example VIII with the exception that vanadyl phthalocyanine photogenerating pigment was selected. A photogenerator layer, 0.5 micron in thickness, comprising 30 percent by weight of vanadyl phthalocyanine dispersed in 70 percent by weight of polyester PE-100 available from Goodyear Chemicals were coated on top of the titanized MYLAR® substrate. The above charge generator layer was overcoated with a hole transport layer comprised of 60 weight percent of the resin binder poly(p-isopropyl alpha-methyl styrene) of Example IV and 40 percent of the aryl diamine hole transport molecule. This imaging member exhibited a dark development potential ($V_{ddp}$) of −870 volts, a dark decay of −30 volts per second, a photosensitivity at 790 nanometers as measured by $E_{1/2}$ of 4.3 ergs/cm$^2$.

EXAMPLE X

There was prepared a photoconductive imaging member by the fabrication process of Example VIII with the exception that the diblock copolymer poly(styrene-benzylmethacrylate) was used as the resin binder in the charge transport layer. Toluene was used as the coating solvent for coating and the typical thickness of the charge transport layer is about 25 microns. Also, a similar control imaging member with MAKROLON™ (polycarbonate) as the resin binder in the charge transport layer was prepared with dichloromethane as the coating solvent by repeating the above. The electrical stability of the imaging members was determined by xerographic cycling in a drum scanner. The drum scanner simulates the xerographic process. The imaging member in the form of coating on a substrate is mounted on a metallic cylindrical drum which can be rotated on a shaft and is charged with a corotron. The surface potential is measured as a function of time by several capacitively coupled probes placed at different locations around the drum. The imaging member is exposed and erased with light sources located at appropriate positions around the drum. The drum speed can be varied in the typical range of about 10 rpm to 100 rpm, and a desired speed can be chosen to conform to the requirements of the test and is controlled to be constant during the test.

Xerographic cycling was accomplished in a drum scanner operating at a speed of 20 rpm. The imaging member with the diblock copolymer as well as the control device were taped on an aluminum drum and tested under the same conditions in a controlled environment of 20° C. and 40 percent RH. The cycling test was accomplished for 25,000 cycles, followed by 12 hours rest and continued for another 25,000 cycles, followed by 12 hours rest, etc. to obtain a total cycling test for 100,000 cycles. Each cycle in the test involved charging the device with a corotron, measuring the surface potential at 0.2s after charging, designated as the dark development potential $V_{ddp}$; exposing with a light source and measuring the surface potential 0.2s after exposure, designated as the background potential $V_{bkg}$; followed by an erase with another light source and measuring the surface potential 0.28s after erase, designated as the residual potential $V_{residual}$. The results are shown in Table 1 and also in FIGS. 1 and 2.

TABLE 1

Xerographic Cycling Stability

| CHARGE TRANSPORT LAYER CTL | CTL COATING SOLVENT | $\Delta V_{ddp}$ Volts | $\Delta V_{res}$ Volts |
|---|---|---|---|
| 50% TPD; 50% Poly(styrene-benzyl methacrylate) | Toluene | −140 | 12 |
| 50% TPD; 50% | Dichloromethane | −149 | 10 |

TABLE 1-continued

Figure 2:
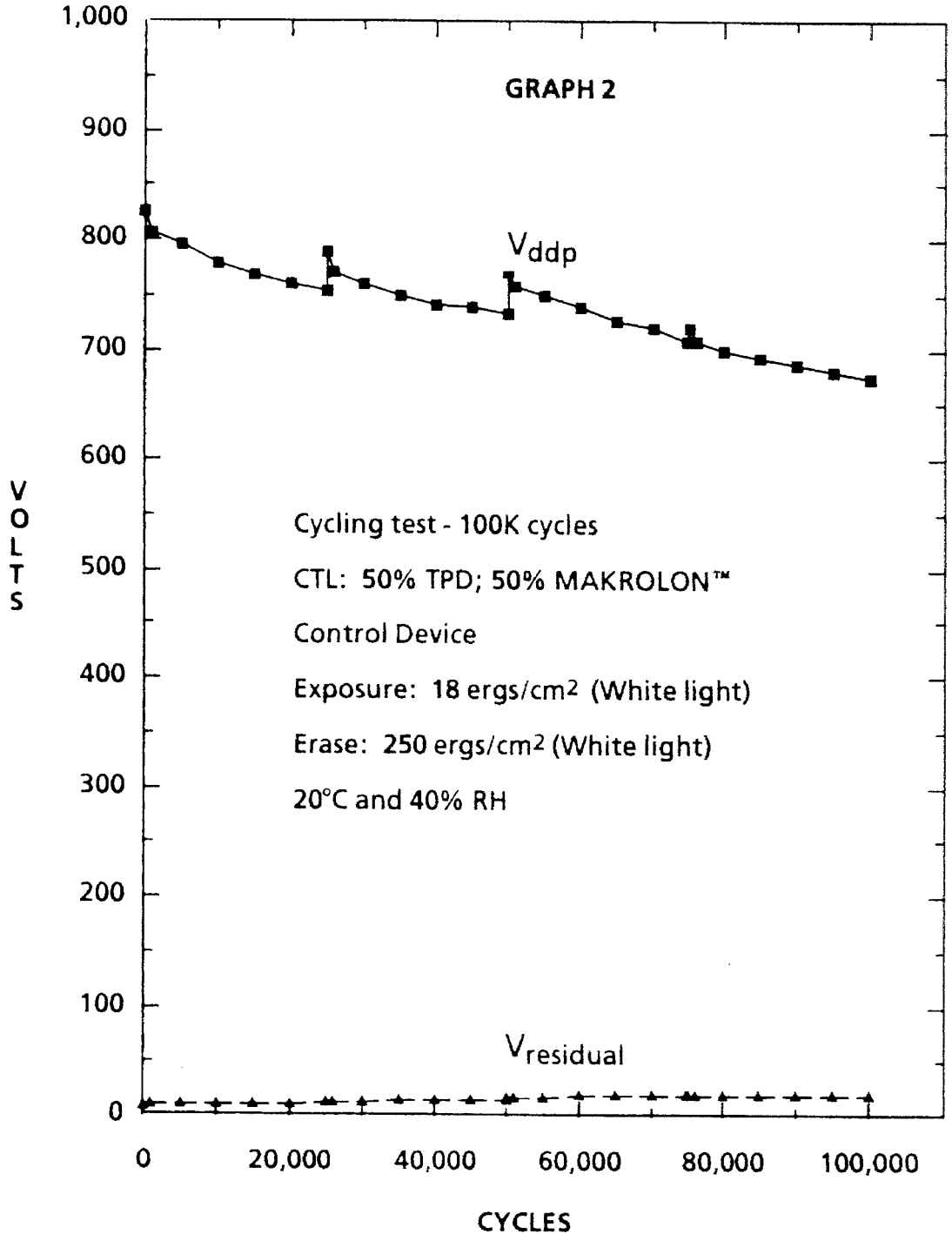
Figure 3:
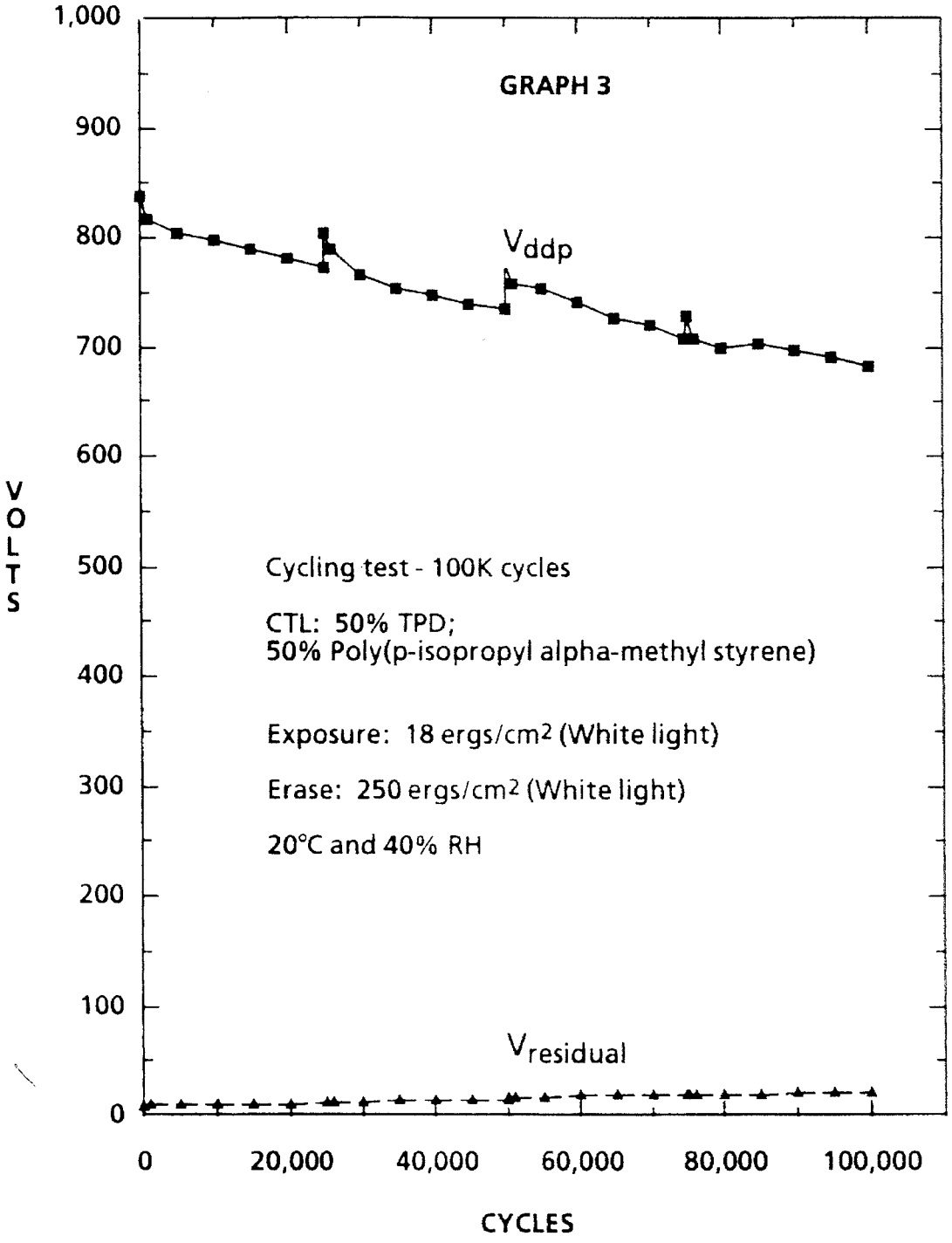
Figure 4:
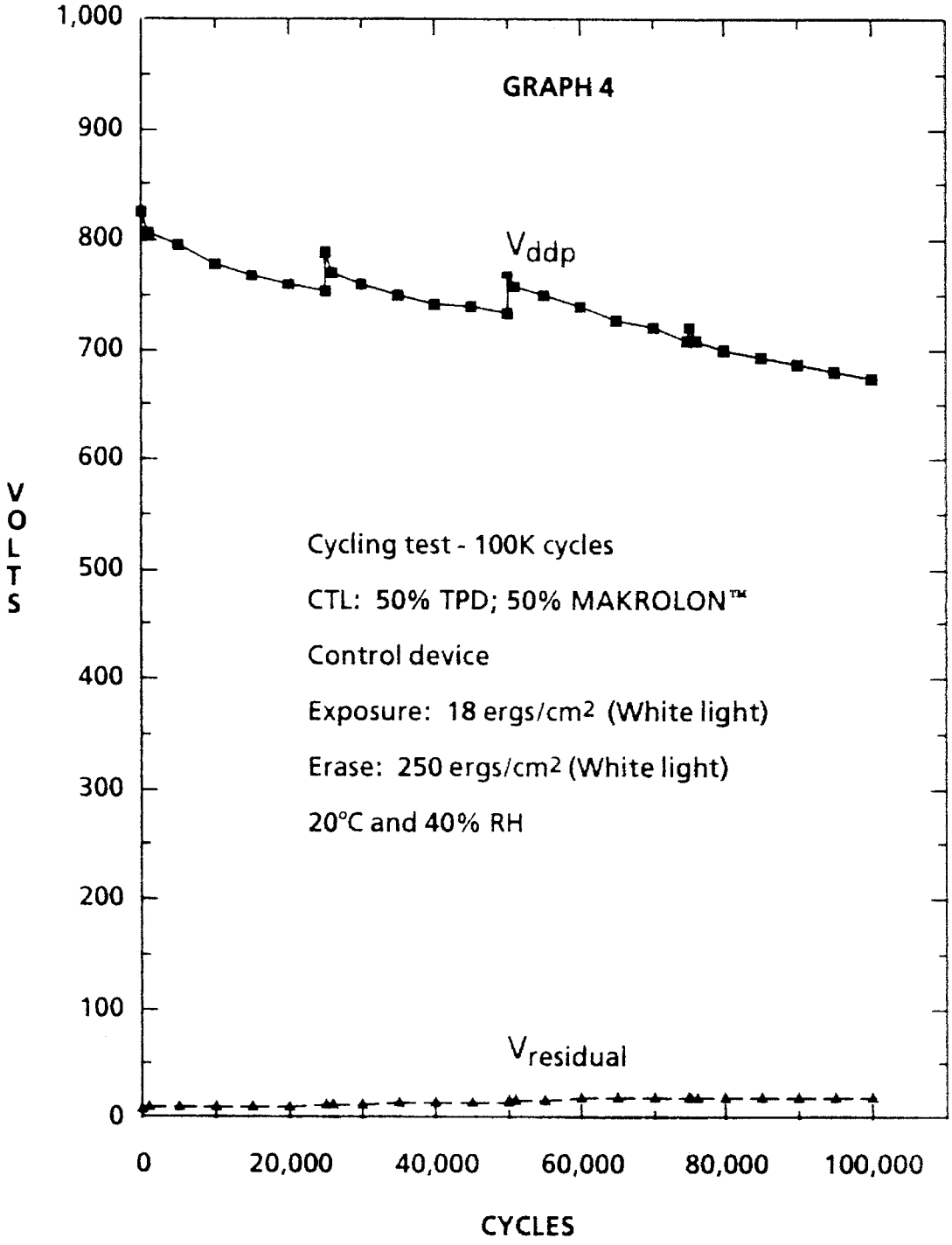

| Xerographic Cycling Stability | | | |
|---|---|---|---|
| CHARGE TRANSPORT LAYER CTL | CTL COATING SOLVENT | $\Delta V_{ddp}$ Volts | $\Delta V_{res}$ Volts |
| MAKROLON ™ Polycarbonate | | | |

the novel diblock copolymer poly(styrene-benzylmethacrylate) of the present invention has similar electricals as the control photoreceptor. It is generally recognized that the cycledown ($\Delta V_{ddp}$) is determined primarily by the charge generation layer and the cycleup ($\Delta V_{res}$) is determined primarily by the charge transport layer. The results evidence that the cycleup is only 10 to 12 volts after 100,000 cycles in both instances, indicating excellent cycling stability. The larger cycledown of about 140 to 149 volts is determined primarily by the trigonal selenium coating which is used in both devices. The results in FIGS. 1 and 2 illustrate graphical plots of the variations in the dark development potential $V_{ddp}$ as a function of the number of cycles. The data on the X-axis refers to the number of cycles in the test and the data on the Y-axis refers to the dark development potential $Vdd_p$. The data is plotted at intervals of 5,000 cycles and the devices are rested after 25,000 cycles. The increase in $V_{ddp}$ at 25,000; 50,000 and 75,000 cycles is due to a partial recovery during the rest period of the loss in $V_{ddp}$ during the cycling. The graphs illustrate that the imaging member with the diblock copolymer as the resin binder in the charge transport layer as well as the control device with MAKROLON™ polycarbonate as the resin binder exhibit a similar decrease of about 140 volts in $V_{ddp}$. The increase in $V_{residual}$ is limited to about 12 volts in a total cumulative test for 100,000 cycles indicating no variation due to the use of the poly(styrene-benzylmethacrylate) as the resin binder in the charge transport layer.

EXAMPLE XI

There was prepared a photoconductive imaging member using the fabrication procedures described in Example VIII with the exception that poly(p-isopropyl alpha-methyl styrene) was used as the resin binder in the charge transport layer. Toluene was used as the coating solvent for coating and the typical thickness of the charge transport layer is about 25 microns. A similar control device or photoconductive imaging member with MAKROLON™ (polycarbonate) as the resin binder in the charge transport layer was prepared with dichloromethane as the coating solvent. The electrical stability of the imaging members was determined by xerographic cycling in a drum scanner. Xerographic cycling was carried out in a drum scanner operating at a speed of 20 rpm and following the procedure as outlined in Example IX. The cycling test was accomplished for 25,000 cycles, followed by 12 hours rest, and continued for another 25,000 cycles, followed by 12 hours rest, until a total of 100,000 cycles. The results are shown in Table 2 and also in FIGS. 3 and 4.

TABLE 2

| Xerographic Cycling Stability | | | |
|---|---|---|---|
| CHARGE TRANSPORT LAYER CTL | CTL COATING SOLVENT | $\Delta V_{ddp}$ Volts | $\Delta V_{res}$ Volts |
| 50% TPD; 50% Poly(p-isopropyl | Toluene | −155 | 12 |

TABLE 2-continued

| Xerographic Cycling Stability | | | |
|---|---|---|---|
| CHARGE TRANSPORT LAYER CTL | CTL COATING SOLVENT | $\Delta V_{ddp}$ Volts | $\Delta V_{res}$ Volts |
| alpha-methyl styrene) 50% mTPD; MAKROLON ™ | Dichloro-methane | −149 | 10 |

The results indicate the changes in $V_{ddp}$ and $V_{residual}$ after 100,000 cycles and demonstrate that the photoreceptor device with poly(p-isopropyl-alpha-methylstyrene) has similar electricals as the control device. It is generally recognized that the cycledown ($\Delta V_{ddp}$) is determined primarily by the charge generation layer and the cycleup ($\Delta V_{res}$) is determined primarily by the charge transport layer. The results indicate that the cycleup is only 10 to 12 volts after 100,000 cycles for both imaging members, indicating excellent cycling stability. The larger cycledown of about 149 to 155 volts is primarily determined by the trigonal selenium coating which is used in both devices.

EXAMPLE XII

A wear test fixture was set up to measure the relative wear and wear rates of charge transport layers subjected to toner interactions and blade cleaning. Imaging members fabricated with toluene as the coating solvent and described in Examples VII to XI were used by wrapping them around and taping onto an aluminum drum in the test fixture. The drum speed controlled by a motor can be varied and is usually maintained at about 55 rpm during the test. Toner is supplied continuously from a hopper and cleaning was achieved by a cleaning blade. The typical test conditions during a wear test are described as follows:

Toner: 46.7 percent of polystyrene/n-butylacrylate copolymer, 49.6 percent of cubic MAGNETITE BL220™, 1.0 percent of P51™ charge control additive, which additive is available from Orient Chemicals, 2.5 percent of 660P™ wax available from Sanyo Chemicals of Japan, and as a surface additive 0.2 percent of AEROSIL R972®

Blade: Xerox 1065 cleaning blade Drum speed: 55 rpm

Number of cycles: 50,000

A new cleaning blade is used in each test. The blade force is about 30 grams/centimeter and is adjusted by a micrometer mounted on the blade holder and measured with a load cell. The wear is determined as the loss in thickness of the charge transport layer and is the difference in thickness of the charge transport layer before and after the wear test. The wear is expressed in microns (μm). The wear rate is obtained by dividing the wear by the number of cycles and is expressed as nanometers/kcycle. The wear rate is normalized and is independent of any variations in the total number of cycles of the wear tests. A similar control photoconductive imaging member was prepared with polycarbonate, PCZ, as the binder in the charge transport layer and tetrahydrofuran/toluene as the coating solvent and also wear tested. The results are shown in Table 3.

TABLE 3

| Wear Test Results Photoreceptors Fabricated With Nonchlorinated Solvents | | |
|---|---|---|
| CHARGE TRANSPORT LAYER (CTL) | CTL SOLVENT COATING | WEAR RATE NM/KCYCLE |
| 50% TPD; 50% PCZ PCZ 77,000 (FX) | Tetrahydrofuran/ Toluene | 51 |
| 50% TPD; 50% Poly (styrene-benzylmethacrylate) | Toluene | 28 |
| 50% TPD; 50% Poly (styrene-isoprene) | Toluene | 31 |
| 50% TPD; 50% Poly(alpha-methylstyrene) | Toluene | 35 |
| 50% TPD; 50% Poly(p-iso-propyl alpha-methylstyrene) | Toluene | 28 |

and indicate a significant improvement by a factor of about 2 in the mechanical wear resistance of the charge transport layers fabricated with diblock copolymers and substituted polystyrenes as the binder of the present invention compared with polycarbonate PCZ as the binder in the charge transport layer.

Other embodiments and modifications of the present invention may occur to those skilled in the art subsequent to a review of the information presented herein; these embodiments and modifications, as well as equivalents thereof, are also included within the scope of this invention.

What is claimed is:

1. An imaging member consisting essentially of supporting substrate, a photogenerator layer and a charge transport layer comprised of charge transport molecules dispersed in a diblock copolymer resin binder selected from the group consisting of styrene-phenylmethacrylate, styrene-benzylmethacrylate, styrene-cyclohexylmethacrylate, styrene-isoprene, poly(p-isopropyl alpha-methyl styrene), poly(alpha-methylstyrene), poly(vinyl toluene), and poly(vinyl benzyl chloride); and wherein said charge transport molecules are represented by the formula

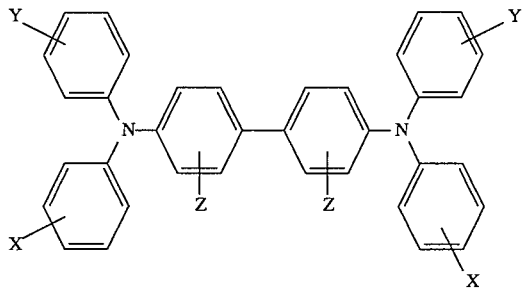

wherein X, Y and Z are selected from the group consisting of hydrogen, an alkyl group and halogen wherein at least one of X, Y and Z is independently an alkyl group or halogen, and wherein said photogenerator layer is comprised of a photogenerating pigment or pigments dispersed in a resinous binder dissimilar than said diblock copolymer.

2. An imaging member in accordance with claim 1 wherein the resin binder has a weight average molecular weight of from about $1\times10^4$ to about $1\times10^6$, and number average molecular weight of from about $5\times10^3$ to about $8\times10^5$.

3. An imaging member in accordance with claim 1 wherein the resin binder is a diblock copolymer of styrene-phenylmethacrylate.

4. An imaging member in accordance with claim 1 wherein the photogenerator layer is situated between the substrate and the charge transport layer.

5. An imaging member in accordance with claim 1 wherein the charge transport layer is situated between the substrate and the photogenerator layer.

6. An imaging member in accordance with claim 1 wherein the supporting substrate is comprised of a conductive substrate comprised of a metal.

7. An imaging member in accordance with claim 6 wherein the conductive substrate is aluminum, aluminized poly(ethylene terephthalate), or a titanized poly(ethylene terephthalate).

8. An imaging member in accordance with claim 1 wherein the photogenerator layer has a thickness of from about 0.05 to about 10 microns.

9. An imaging member in accordance with claim 2 wherein the photogenerator layer has a thickness of from about 0.05 to about 10 microns.

10. An imaging member in accordance with claim 1 wherein the photogenerating compound is dispersed in said resinous binder in an amount of from about 5 percent by weight to about 95 percent by weight.

11. An imaging member in accordance with claim 10 wherein the resinous binder is selected from the group consisting of polyesters, polyvinyl butyrals, polycarbonates, and polyvinyl formals.

12. An imaging member in accordance with claim 1 wherein the charge transport layer comprises the aryl amine molecules N,N'-diphenyl-bis(3-methylphenyl),- 1,1'-biphenyl-4,4'-diamine.

13. An imaging member in accordance with claim 1 wherein alkyl contains from about 1 to about 25 carbon atoms.

14. An imaging member in accordance with claim 13 wherein alkyl contains from 1 to about 10 carbon atoms.

15. An imaging member in accordance with claim 13 wherein alkyl is methyl.

16. An imaging member in accordance with claim 13 wherein halogen is chlorine.

17. An imaging member in accordance with claim 1 wherein the resinous binder is selected from the group consisting of copolymers of about 56 percent polystyrene-about 44 percent poly(benzyl methacrylate), about 60 percent polystyrene-40 percent poly(cyclohexyl methacrylate), and 60 percent polystyrene-40 percent poly(phenyl methacrylate) with a weight average molecular weight of from about $1\times10^4$ to about $1\times10^6$, and number average molecular weight of from about $5\times10^3$ to about $8\times10^5$.

18. A method of imaging which comprises generating an electrostatic latent image on an imaging member of claim 1, developing the latent image, and transferring the developed electrostatic image to a suitable substrate.

19. A method of imaging which comprises generating an electrostatic latent image on an imaging member of claim 2, developing the latent image, and transferring the developed electrostatic image to a suitable substrate.

20. An imaging member in accordance with claim 1 wherein the charge transport layer is prepared by forming a solution in toluene of said charge transport molecules and said resin binder.

21. An imaging member consisting essentially of supporting substrate, a photogenerator layer and a charge transport layer comprised of charge transport molecules dispersed in a diblock copolymer resin binder selected from the group consisting of styrene-phenylmethacrylate, styrene-benzylmethacrylate, styrene-cyclohexylmethacrylate, styrene-isoprene, poly(alpha-methylstyrene) and poly(vinyl toluene); and wherein said charge transport molecules are represented by the formula

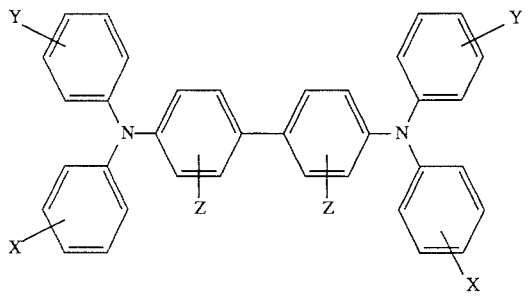

wherein X, Y and Z are selected from the group consisting of hydrogen, an alkyl group and halogen wherein at least one of X, Y and Z is independently alkyl group or halogen wherein the aryl amine is dispersed in a highly insulating and transparent organic resinous binder; and wherein said charge transport layer is formed from a solution of toluene, said transport molecules and said resin.

22. An imaging member in accordance with claim 21 wherein the resin binder is polystyrene-poly(benzyl methacrylate) with 56 percent of polystyrene and 44 percent of poly(benzyl methacrylate).

* * * * *